US007658398B2

(12) United States Patent
Panzeri

(10) Patent No.: US 7,658,398 B2
(45) Date of Patent: Feb. 9, 2010

(54) ROTATING CONNECTION SYSTEM WITH BRAKING MEANS

(76) Inventor: Ezio Panzeri, 101 Shrewsbury Road, Shrewsbury Park, Ballsbridge, Dublin (IE) D4

( * ) Notice: Subject to any disclaimer, the term of this patent is extended or adjusted under 35 U.S.C. 154(b) by 559 days.

(21) Appl. No.: 11/481,920

(22) Filed: Jul. 7, 2006

(65) Prior Publication Data

US 2007/0013165 A1 Jan. 18, 2007

(30) Foreign Application Priority Data

Jul. 7, 2005 (GB) ..... 0513857.3

(51) Int. Cl.
*A63C 9/02* (2006.01)

(52) U.S. Cl. ..... 280/618; 280/14.24

(58) Field of Classification Search ..... 280/607, 280/617, 618, 623, 624, 629, 633, 634, 636, 280/14.21, 14.22, 14.24, 11.14
See application file for complete search history.

(56) References Cited

U.S. PATENT DOCUMENTS 2,955,300 A * 10/1960 Hedlund et al. ..... 441/68
3,917,298 A * 11/1975 Haff ..... 280/607
4,185,851 A * 1/1980 Salomon ..... 280/613
RE33,544 E * 2/1991 Dennis ..... 280/618
5,188,386 A * 2/1993 Schweizer ..... 280/607
5,586,779 A 12/1996 Dawes et al.
5,803,467 A * 9/1998 Piotrowski ..... 280/7.14
6,022,040 A 2/2000 Buzbee
6,296,258 B2 * 10/2001 Higgins et al. ..... 280/14.22
6,302,428 B1 10/2001 Jungkind
6,450,511 B1 9/2002 LaVoy
6,491,310 B1 * 12/2002 Work ..... 280/14.24
6,676,152 B2 * 1/2004 Gonthier ..... 280/623

(Continued)

FOREIGN PATENT DOCUMENTS

EP 0 285 558 10/1988

(Continued)

OTHER PUBLICATIONS

Young, Craig C. and Niedfeldt, Mark W., "Snowboarding Injuries," *American Family Physician*, V. 59/No. 1, Jan. 1999.

*Primary Examiner*—Frank B Vanaman
(74) *Attorney, Agent, or Firm*—Bacon & Thomas, PLLC

(57) ABSTRACT

A connection system for connecting a board 1 to a boot comprises a plate 5 which is connectable to the board 1, a button 3 having a bottom face and a top face, the top face being connectable to a boot or binding 2, and a collar 4, wherein a part of the button 3 is sandwiched between the collar 4 and the plate 5 with its bottom face adjoining the plate 5, and its top face exposed through the collar 4, such that it can rotate about an axis passing through the connection system and wherein the bottom face of the button 3 has a curved surface, which has rotational symmetry with and which adjoins a complimentary curved surface on the plate 5, such that button 3 can roll to move its axis of rotation A away from an axis P perpendicular to the plate 5, and in that the connection system comprises braking means 8, which restricts movement of the button 3.

17 Claims, 20 Drawing Sheets

U.S. PATENT DOCUMENTS

| | | | | |
|---|---|---|---|---|
| 6,789,806 | B2 * | 9/2004 | Santa Cruz et al. | 280/14.21 |
| 7,097,195 | B2 * | 8/2006 | Orr et al. | 280/628 |
| 7,290,785 | B2 * | 11/2007 | Dixon | 280/617 |
| 2003/0038455 | A1 | 2/2003 | Lett | |

FOREIGN PATENT DOCUMENTS

| | | | |
|---|---|---|---|
| JP | 2000-70432 | | 3/2000 |
| JP | 2003-24496 | | 1/2003 |
| JP | 2008-11950 | * | 1/2008 |

* cited by examiner

ROTATING CONNECTION SYSTEM WITH BRAKING MEANS

FIELD OF THE INVENTION

The present invention relates to a connection system for connecting a board to a boot. The connection system is a rotating mechanism for fitting between the board and the boot, or between the board and a conventional binding. The connection system of the invention allows both rotational and rolling motion of the boot relative to the board. A braking system is provided to restrict the rolling motion. It is primarily for use with sports boards such as snowboards, but conceivably could be used in conjunction with wake boards, kite boards or any similar board which uses a binding to secure the foot of a user to the board.

BACKGROUND

Various mechanical bindings for snowboards are known. Typically these comprise a cage of straps that is secured directly to the snowboard that the user straps his foot into. The user's foot is effectively bound to the snowboard. Other systems are known in which a mechanical quick release fitting is provided on the bottom of the user's boot and this connects with a corresponding fitting secured to the board. Such connection systems are also referred to as "bindings". The known bindings have a fixed angular position with respect to the board during use. They can be loosened to adjust the position of the binding using a screwdriver or allen key. This system is used to adjust the binding set-up to the rider's preference before riding takes place. However, bindings are also known in which rotation is enabled while the boot is fitted in order to allow the rider to more easily use a lift, or to move easily when there is no slope.

JP2003/024496 discloses bindings that are attached to a snowboard via setting device that comprises a base member attached to screw holes in the board; a rotating member rotatably supported against the base member; a pressure contact plate pressed into contact with part of the rotating member; and a fixing means for fixing the pressure contact plate in place using fixing screws. By loosening the fixing screws, which can be wing nuts, the rider can release the pressure contact plate, thereby allowing the binding to rotate.

U.S. Pat. No. 6,450,511 discloses a swivelable mount for the boot bindings of a snowboard or wakeboard or the like, including a low profile top plate which joins to the binding structure and a circular bottom plate which attaches to a snowboard. The two plates are slideable relative to each other when a spring pin, mounted to the top plate and extending through a hole in the bottom plate, is drawn upwardly, corresponding to an unlocked, rotatable condition of the top plate for use when on a lift, or manoeuvring the snowboard on flat ground. During riding, the spring-loaded pin is released and engages the opposing bottom plate hole to prevent the top plate from rotating and keep the snowboard rider firmly attached to the snowboard.

U.S. Pat. No. 6,302,428 discloses a snowboard step-in binding having a rotatable sole holder that can be moved between two limit positions and can be opened using an opening lever.

It is a common preconception that bindings should hold the rider's foot in a fixed position whilst the rider is snowboarding down a slope or performing tricks. As a result many of the known bindings are designed not to allow the boot to rotate in the plane of the board or perpendicular to the board during such use.

However, it has been recognised that it may be useful to allow the feet to rotate under some circumstances during use.

In U.S. Pat. No. 6,022,040 several problems with permanently fixed binding systems are discussed. These include the problems of propelling the board along on the flat, which is known as "skating", and using ski lifts easily without needing to place the feet at an unnatural angle. These problems are solved to some extent by the above described "quick-release" systems, which allow the rider to switch to a rotating binding mode when not actually boarding. U.S. Pat No. 6,022,040 also discusses the problem of strain on the knees resulting from adopting an unnatural angle of the feet, and further identifies the problem of changing riding style whilst boarding, and the need for freedom of movement during aerial manoeuvres. To solve all these problems, this document discloses a system in which the feet are allowed to rotate freely about a limited arc when turning is not taking place, but in which during turning radial ridges engage with the base of the riders boot, and prevent rotation. Engagement of the ridges during turning occurs due to the shift of the rider's body weight.

This system has the disadvantage that a catch structure must be attached to the base of the boot, which could hinder the rider's movement when not on the board, and also could prevent the rider from using the boot with other binding systems. Rotation through much more than 90° is not allowed, which could be limiting in some situations. Additionally, by preventing rotation when the rider's body weight shifts during turning, this system would also fix the feet in place in the event of a fall in which similar shifts in weight occurred. The feet and knees could therefore become stuck at a bad angle during a fall, and an injury could result.

As discussed in U.S. Pat. No. 6,022,040, the design of snowboard bindings can contribute to injuries sustained by snowboarders. The incidence and causes of such injuries is discussed in more detail in "Snowboarding Injuries" by Craig C. Young, M.D. and Mark W Niedfeldt, M.D. of the Medical College of Wisconsin, published in American Family Physician, Vol. 59/No. 1, Jan. 1, 1999. In that paper, knee injuries and ankle injuries were found to account for around 16% and 17% of snowboarding injuries respectively. Therefore, if a binding places less strain on the knees and ankles, then the risk of injury should be reduced.

Many snowboarding injuries take place when the rider falls. Beginners often fall regularly and therefore a high percentage of injuries occur during the rider's first experience of snowboarding or in their first season of snowboarding. More advanced riders may fall when attempting jumps or other aerial manoeuvres. One mechanism of ankle injury is a forcing of the ankle into dorsiflexion and inversion, which may occur during a landing from an aerial manoeuvre or a jump, especially when the landing has been over-rotated. Thus, a binding that cannot rotate in a fall due to weight shift of the rider, as might be the case with U.S. Pat. No. 6,022,040, would not prevent these types of injuries.

JP 2000-070432 discloses a system for joining a binding to a board which uses a top plate that is connected to a bottom plate via a bearing in-between them to allow rotational movement of the binding with respect to the board.

By allowing full rotation at all times, the feet and knees can always be placed as the rider wants them, and rotation can always occur during a fall in order to avoid the risk of injury, in particular knee injury caused by restricted foot movement. Additionally by allowing more freedom of movement the board can be easier to use, and there is greater flexibility in the positions that can be taken up during use.

On certain sections of a slope, for example, the rider may prefer to have his foot more in line with the direction of travel, e.g. for speed, or more perpendicular e.g. for turning. It will also relieve some of the strain on the ankle whilst on a chair lift if the front foot can be twisted into a different position with respect to the board. Free rotation may also give rise to new styles of riding a board and allow the more expert user to perform more complex manoeuvres.

However, bearings are by their nature precision components, and therefore can be complex to repair and maintain. It is likely that in a snowboarding environment snow and dirt would penetrate into the casing of a bearing and it would not be easy to clean such a system. In other boarding applications, dust, sand, water or mud could get into the casing. As a result, a bearing based system may be liable to failure due to wear and jamming from trapped dirt, and would be at risk of corrosion of the metal parts if moisture is retained in the casing after use.

Additionally, metal components may suffer when exposed to extremes of cold, as metals generally have high thermal expansion coefficients, which means that additional stresses would be present in a metal device due to differential contraction of differing metals or different shapes in the cold. This could lead to inefficient operation, jamming, or fatigue failure as a result of contraction and expansion when moving the board from a warm building to the cold snow outside. The metal also has to be chosen carefully to avoid a situation where it is below its brittle/ductile transition temperature in normal use under the sub-zero temperatures experienced on the ski slopes.

SUMMARY

The present invention therefore aims to solve the problem of knee and ankle related injuries, without the use of a complex system, and whilst minimising the risk of damage and corrosion under conditions of extreme cold.

Viewed from a first aspect the present invention provides a connection system for connecting a board to a boot comprising; a plate which is connectable to a board, a button having a bottom face and a top face, the top face being connectable to a boot or binding, and a collar, wherein a portion of the button is sandwiched between the collar and the plate with the bottom face of the button adjoining the plate, and the top face of the button exposed through the collar, such that the button can rotate about an axis passing through the connection system characterised in that the bottom face of the button has a curved surface, which has rotational symmetry with and which adjoins a complimentary curved surface on the plate, such that button can roll to move its axis of rotation away from an axis perpendicular to the plate, and in that the connection system comprises braking means for restricting rolling and/or rotational movement of the button when the button is moved away from a neutral position.

The neutral position should be taken to be a central position of the button, such that the button is centrally located on the plate. In this position, the braking means may not be engaged or if it is engaged, acts equally around the surface of the button so as to return the button to this neutral position when no rolling force is exerted by the rider. Preferably the axis of rotation is, in use, substantially perpendicular to the plane of the board.

The use of a plate with a button secured on it by a collar in this way allows the feet to be rotated with respect to the board. The system is a simple sliding joint and contains only one moving part. The simplicity of the design allows the connection system to be constructed to be rugged and durable. It also allows the user to disassemble and re-assemble the connection system easily for routine maintenance such as cleaning the surfaces so that they are free of grit and dirt.

The curved surfaces slideably engage one another and transfer the loading from the rider to the board whilst allowing rotation to occur. A curved surface adds stability to the axis of rotation of the button relative to the plate during rotation. In other arrangements envisaged herein, the bottom face of the button may be formed so that there is only a ring of contact or a pattern of contact with channels similar to a tyre tread for keeping the contact surfaces free from grit.

As the axis of rotation of the button can move away from an axis perpendicular to the plate, the button can also rotate about other axes which are perpendicular to the axis passing through the connection system. This allows the rider's foot to roll relative to the board, which allows greater freedom of movement and may help prevent injuries. Additionally, as the boot can be connected to the connection system or the binding with the board at an angle to the sole of the boot, it becomes easier to fit the boot to the board. A rider would often be seated when fitting a board, and without any rolling rotation the board has to be held perpendicular when fitting the boots. With this system allowing rolling rotation, the board could lay flatter to the snow, making entry into the binding easier.

The use of braking means undesirable large rolling movements of the button can be restrained, and allows the rider to have more control, in addition, the braking means can prevent rotation of the button when the rider wishes to have torsional control of the board. The braking means can allow the button to rotate freely when the button is in a neutral position, for example, when the rider is upright, and can then grip the button when the rider is banked over and the braking means is engaged, for example, when performing turns or other manoeuvres where the rider is applying torque to the board. The wider range of foot positions and the braking means controlling the rolling and rotation, allow the rider to be freer in their movements and is less tiring for the rider.

In a preferred embodiment, the braking means resiliently restricts movement of the button when the axis reaches a predetermined angle from the perpendicular. This improves the rolling characteristics of the connection system, and means that a cushioned 'stop' is provided instead of a more sudden 'stop'. The use of a resilient braking means allows further rolling movement of the button when sufficient force is applied. Thus, in the even of a crash when large forces are applied to the riders knees and ankles, the connection system has a measure of 'give' which can prevent injury to the rider.

Preferably the braking means is arranged to prevent rotation of the button through friction when the braking means is engaged. Thus, the rider can achieve a fixed (non-rotating) foot position as required by applying force or angling the button to engage the braking means.

A locking device may be provided to restrict rotational movement of the button whilst allowing rolling movement. This allows the connection system to be used in a configuration where the rider does not wish to allow rotation of the foot. The locking device may be a latch which engages with a recess on the button. There may be a number of recesses on the button to enable it to be locked in a range of positions.

The braking means may comprise a ring of resilient material. The use of a ring ensures that the braking means operates the same way around all points of the button. A ring is also simple to manufacture and may be available as an off the shelf part, for example as a rubber ring for use as a seal or similar. This also has the advantage that a range of different rings could be sold to the rider in a kit and the rider could chose the ring which is of the most appropriate size and mechanical properties to best suit the rider's style and experience.

Preferably the braking means is located about the button, so that when the axis reaches the predetermined angle the braking means is compressed between the button and another part of the connection system, such as the plate or the collar. The braking means in this embodiment could be a ring about the rim of the button, or a ring located on the plate or the collar at a suitable position. It will be appreciated that various arrangements could be used to achieve the desired function of the braking means.

In a preferred embodiment the braking means is arranged to provide an urging force to return the button to a neutral position when the button is engaged with the braking means. Thus, when force applied by the rider or due to manoeuvring of the board is released, the button can automatically return to the central neutral position.

The braking means could be made of Rubber, Silicon, PA (Nylon), PPT (Polyester), Acetylic. Other materials could be used which have suitable elastic and frictional properties.

There may be more than one braking means placed to contact with the top and the bottom of the rim of the button. The braking means may be a resilient and/or high friction material formed as segments of a ring or a whole ring, or a rubber coating provided on the button, collar or plate.

Alternatively, the braking means could be implemented by contouring of curve of the plate and/or button to give an increasing resistance to rolling and/or rotational movement as the button moves from its neutral position. A further alternative would be to use ridges on the plate and the button, so that as the button moves from its neutral position the ridges engage with one another and rotational motion is restricted.

The top face of the button can advantageously be arranged to be connectable to a binding, for instance by means of standard mounting holes as discussed below. However, the top face of the button may be connectable to the boot more directly, for instance, a plate or cleat could be provided on the sole of the boot, preferably on the recess between toe and heel so that walking is not hindered, and the top face of the button could be arranged to engage with the plate or cleat to connect the boot to the button.

In a preferred embodiment the plate includes a domed surface which corresponds to a section of a sphere, and the button has a cup or cavity of corresponding shape. This shape, having a smooth curved surface, minimises entrapment of snow and ice between the button and the plate and collar assembly which could otherwise hinder movement.

In a preferred embodiment the plate has mounting holes arranged to allow connection to one or more of standard 4 hole, 6 hole or Burton arrangements provided in a board for a conventional binding. Similarly, the button may have mounting holes arranged to allow connection to one or more of standard 4 hole, 6 hole or Burton arrangements in a binding. The plate can therefore be connected to a conventional standard board, and the button can be connected to a conventional binding without having to modify the existing fittings. This allows the user simply to insert the rotating connection system between their existing board and bindings, without the need to replace their board, boots or bindings. As a result, the system of these embodiments is cheap to buy and easy to try out without the need for buying lots of equipment.

Preferably the plate has a plurality of lugs on its upper surface arranged around its outer edge and the collar has a corresponding plurality of recesses on its under surface arranged around its outer edge for engagement with the lugs. This ensures that the collar is securely and non-rotatably fixed to the plate, and the joint does not interfere with the movement of the button as it is placed away from the moving part.

As the connection system is made of from three simply shaped components, it can be easily manufactured and assembled. One or more of the various parts of the system may be made of a polymer material such as nylon or Teflon. Polymer compositions based on one or more polymers may also be used. Other suitable polymers include polyethylene, polyacrylates, polyurethanes and compositions including those materials. Polymer materials are advantageous as they can be easily and cheaply formed into complex shapes, and can be tough, corrosion resistant and low friction. The also generally have low thermal expansion coefficients. The system of the invention can therefore be constructed from parts which are hardwearing and resistant to environmental effects and changes in temperature. Further, in the event of any damage or wear, maintenance and repairs are simply a case of replacing parts as necessary, and can be carried out with minimal technical knowledge.

One or more of the parts of the whole connection system may be manufactured using injection moulding. If desired, the different parts of the connection system can be manufactured using different materials or manufacturing methods. For example, the plate can be made from a strong material to transfer forces between the button and the board without risk of damage, for example, it could be made of a metal such as aluminium, titanium or steel, and the button can be made from a low friction material, such as the polymers discussed above. The plate, button and collar materials should be selected to give low friction and high wear resistance at the sliding contact between button and plate, and between button and collar.

The connection system may have other uses than on a snowboard, for example, anywhere where a binding is used to fix the rider's foot to a piece of equipment. Examples of such equipment include a wakeboard, skateboard, mountain board, windsurf, kite board, power board, or any other kind of sports board.

In embodiments where the curved surfaces of the plate and the bottom of the button are sections of a sphere, rotation in a rolling motion relative to the board can be achieved when there is a space between edge of the hole in the collar and the edge of the portion of the button which protrudes up through the hole. This "rolling" effect also provides the advantage of allowing the board to tilt slightly with respect to the rider, whilst the board is in motion. Thus small bumps or hollows in the surface of hard piste can be taken up easily by the board angle changing slightly without disturbing the balance or weight of the rider. This can provide the rider with a softer ride—a suspension type of effect. The system is also believed to improve the way in which the board flexes from front to rear during riding to increase performance. The use of a braking ring in the connection system can further improve this effect.

From a second and third aspect the present invention provides a snowboard having a connection system as discussed above fitted to a first foot position of the snowboard, and a snowboard having connection systems fitted to a first and second foot position of the snowboard.

From a fourth aspect the present invention provides a kit for a board comprising a connection system, as discussed above having a plate and a collar and wherein more than one button and/or braking means is provided in the kit, the plurality of buttons or braking means being of different sizes, shapes or hardnesses to allow different ranges of movement. For example a different range of movement could also be achieved by providing a number of braking means of varying stiffness so that the movement of the button for a certain force varies with the different braking means. This kit allows the rider to select a different button or braking means for different uses, for instance a greater or lesser range of movement could be selected depending upon whether the rider intends to perform tricks, or if the terrain is rough or smooth. Different materials may also be preferable depending on conditions on the slopes, as temperatures can vary by many tens of degrees.

Viewed from a fifth aspect, the present invention provides a connection system for connecting a board to a boot comprising; a plate which is connectable to a board, a button having a bottom face and a top face, the top face being connectable to a boot or binding, and a collar, wherein a portion of the button is sandwiched between the collar and the plate with the bottom face of the button adjoining the plate, and the top face of the button exposed through the collar, such that the button can rotate about an axis passing through the connection system.

From a further aspect, the present invention can be seen to provide a connection system for connecting the binding or the boot of a rider to a snowboard, the system being configured to allow the rider to rotate his boot with respect to the snowboard through an angle of greater than 45°, more preferably greater than 90° about an axis extending through the connection system and substantially perpendicular to the plane of the board whilst the boot is connected to the snowboard, and also configured to allow the rider to roll his boot to tilt that axis of rotation away from the perpendicular to the plane of the board by more than 3°, and preferably by more than 5°. Deflections of more than 7° and preferably up to 10° are envisaged. Thus the axis of rotation can be titled within an inverted cone angle of 6° or more, preferably 8° or more, and more preferably 10° or more, for example 15 or 20°.

BRIEF DESCRIPTION OF THE DRAWINGS

Preferred embodiments of the present invention will now be described in greater detail by way of example only and with reference to the accompanying drawings in which.

DETAILED DESCRIPTION

Figure 1A:
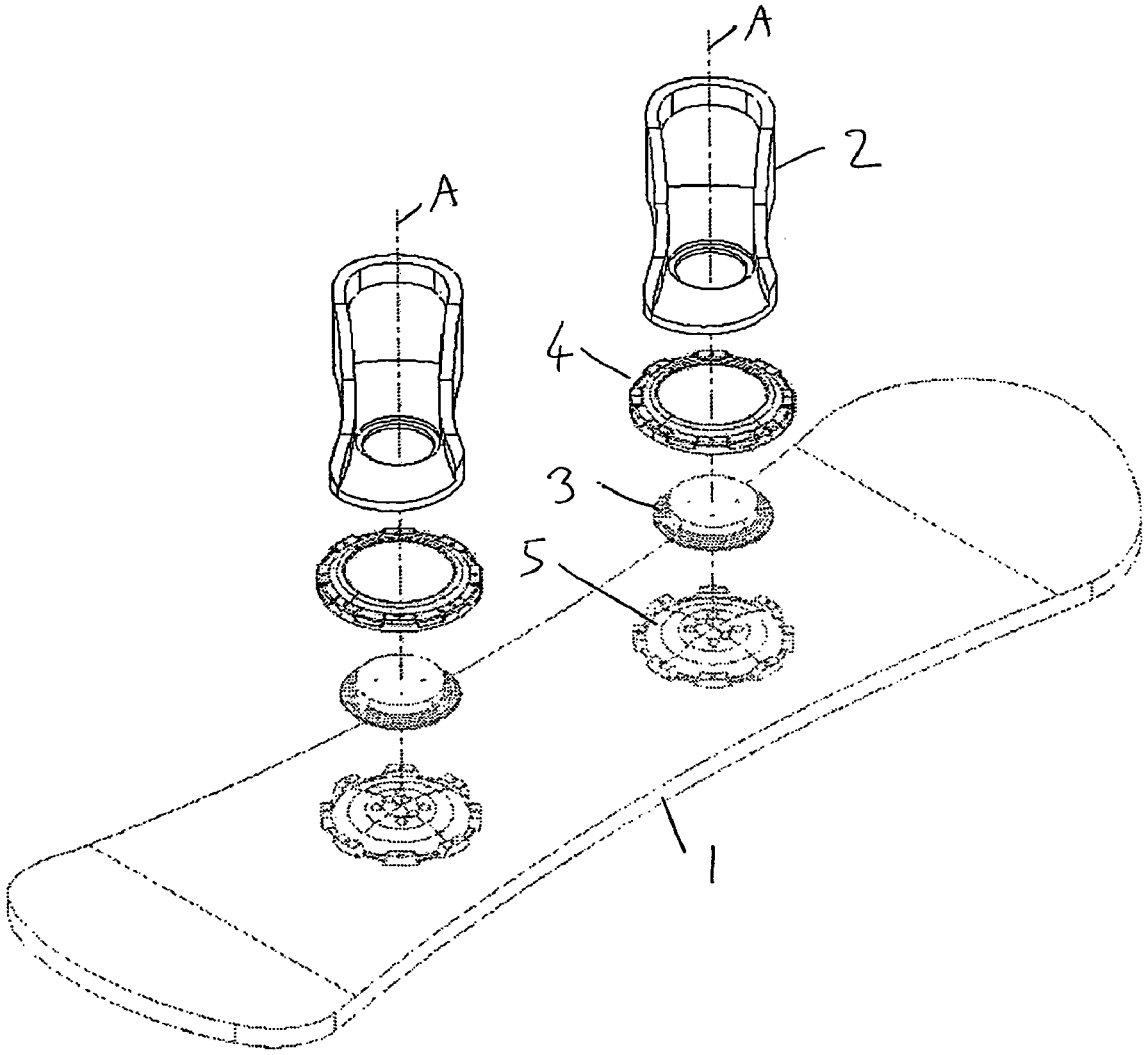
FIG. 1*a* shows a connection system in exploded view ready to be mounted between a board and a binding.
Figure 1B:
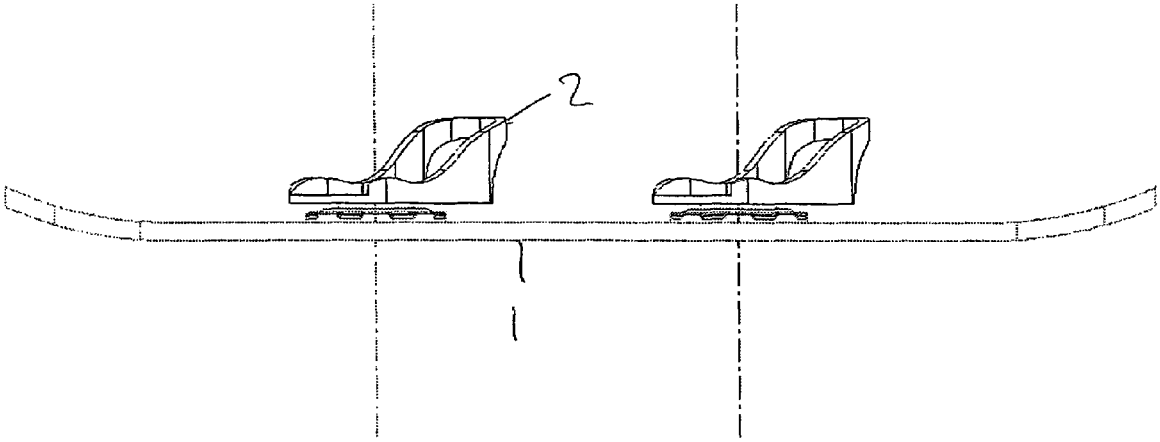
FIG. 1*b* shows the connection system of FIG. 1*a* assembled between a board and a binding in side elevation.

As shown in FIG. 1, the connection system fits between a board 1 and a binding 2. As discussed above, in alternative embodiments, the connection system can be arranged to connect more directly to a boot.

Figure 2:
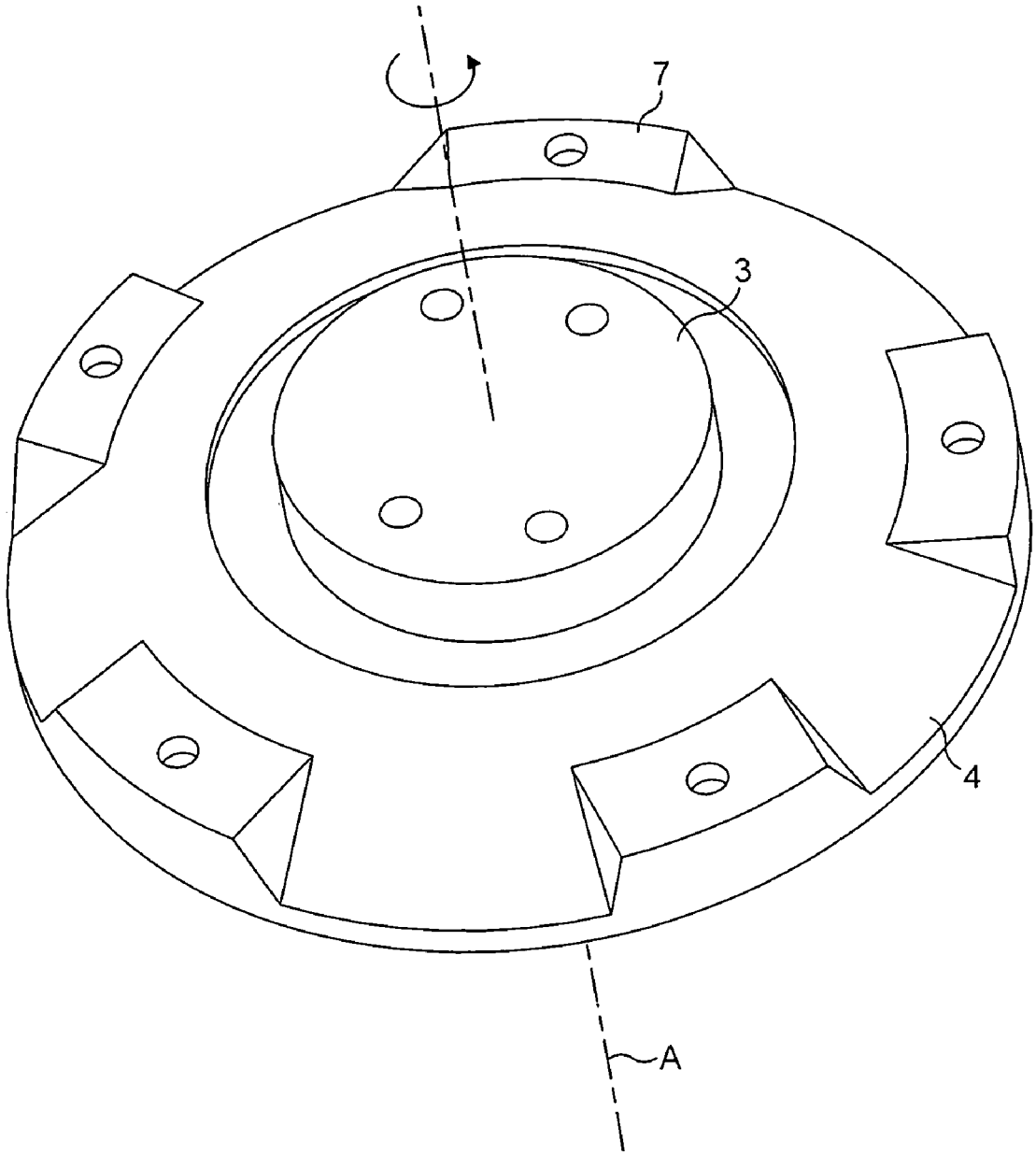
FIG. 2 shows a first embodiment of the connection system.
Figure 3:
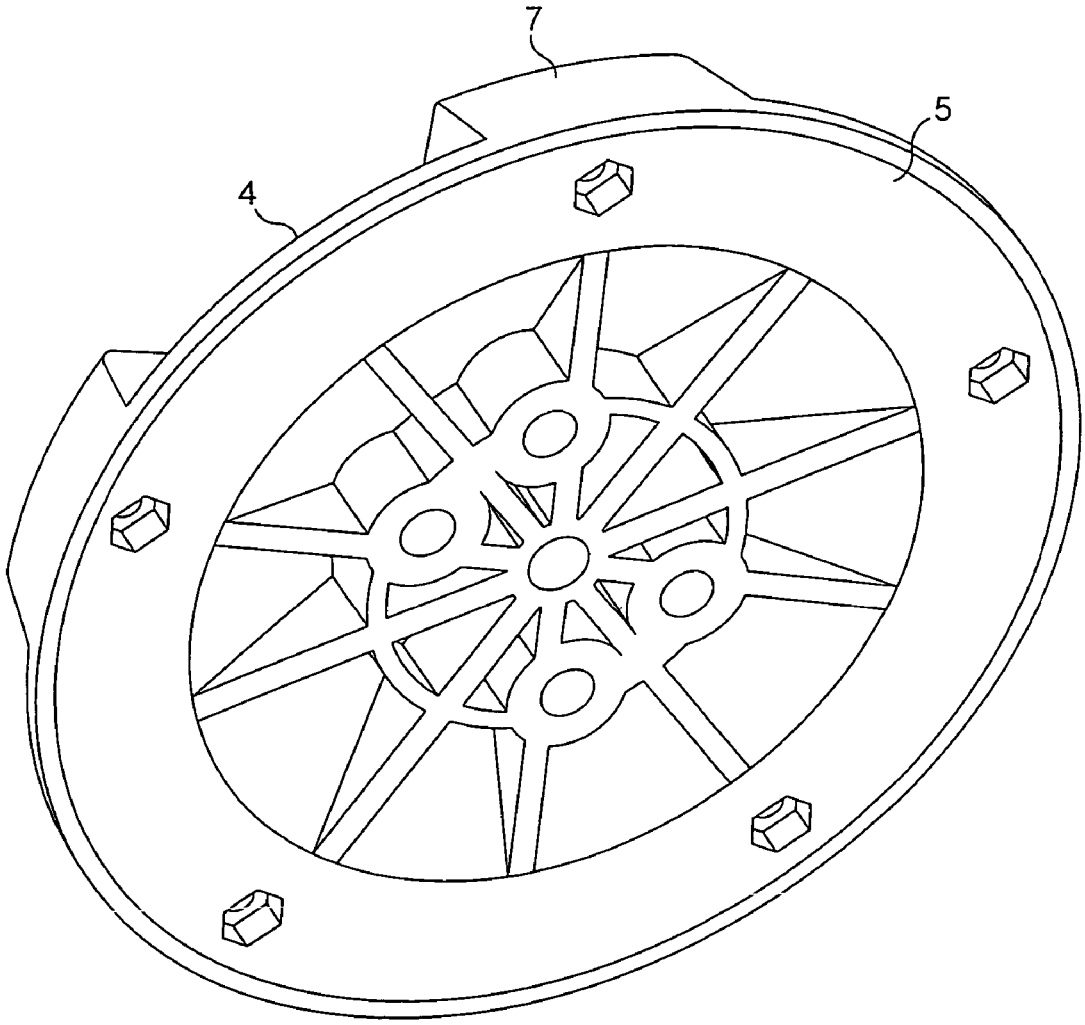
FIG. 3 shows the connection system of FIG. 2 from below.

FIGS. 2 to 6 show a first embodiment of the connection system. A button 3 is mounted between a collar 4 and a plate 5. The button 3 connects to the binding 2 and the plate 5 connects to the board 1. In FIGS. 2 and 3 the three components are assembled. The collar 4 fits tightly onto the plate 5 and encloses the a portion of the rim 3*a* of the button 3. The space between the collar 4 and the plate 5 is slightly larger than the height of the rim 3*a*, so that the button 3 can rotate about an axis A and slide freely between the collar 4 and the plate 5. The top face of the button 3 is exposed through a hole in the collar 4. As the button 3 is free to rotate between the plate 5 and the collar 4 a binding 2 which is connected to it can rotate freely relative to the board 1.

Figure 4:
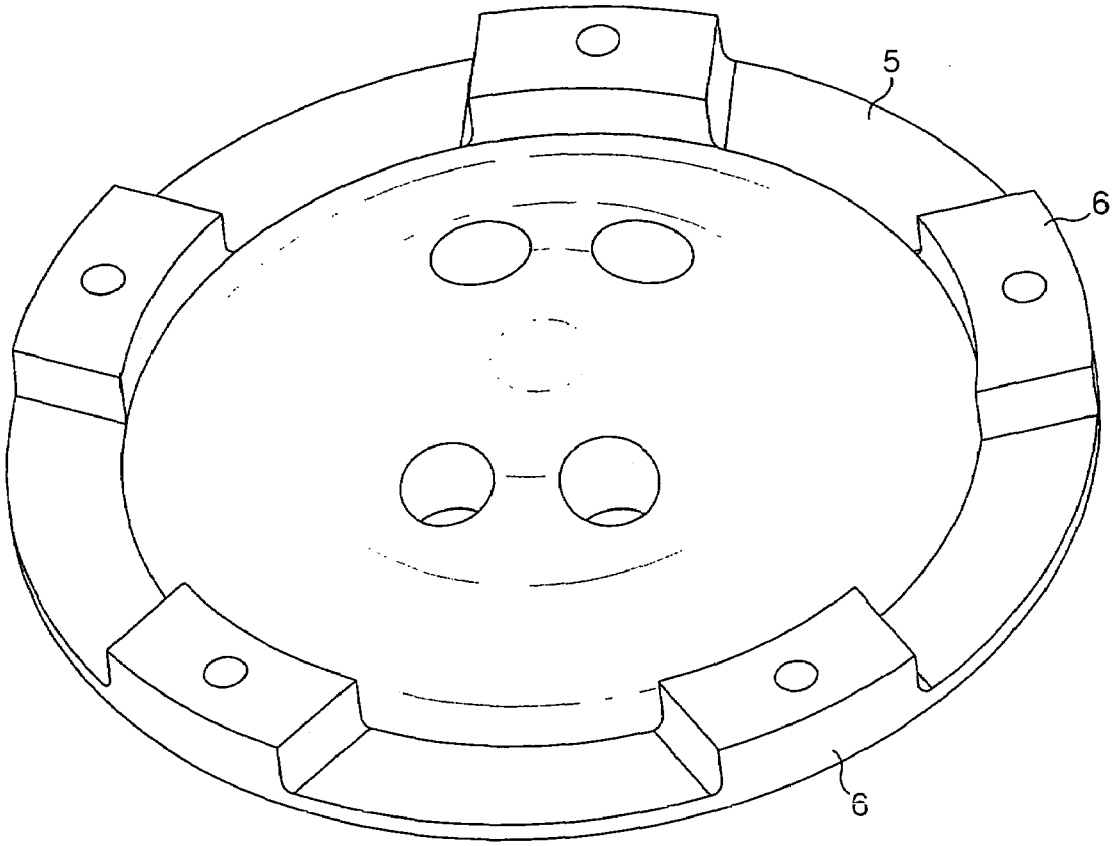
FIG. 4 shows the plate used in the connection system of FIG. 2.

FIG. 4 shows the plate 5 without the collar 4 or button 3. In this embodiment the plate 5 has domed upper surface, which forms a section of a sphere. In the centre of the plate 5 are four holes, which correspond to a standard arrangement of holes on a board. The plate 5 can therefore be fitted to a standard board easily using conventional fittings, such as screws.

Figure 5:
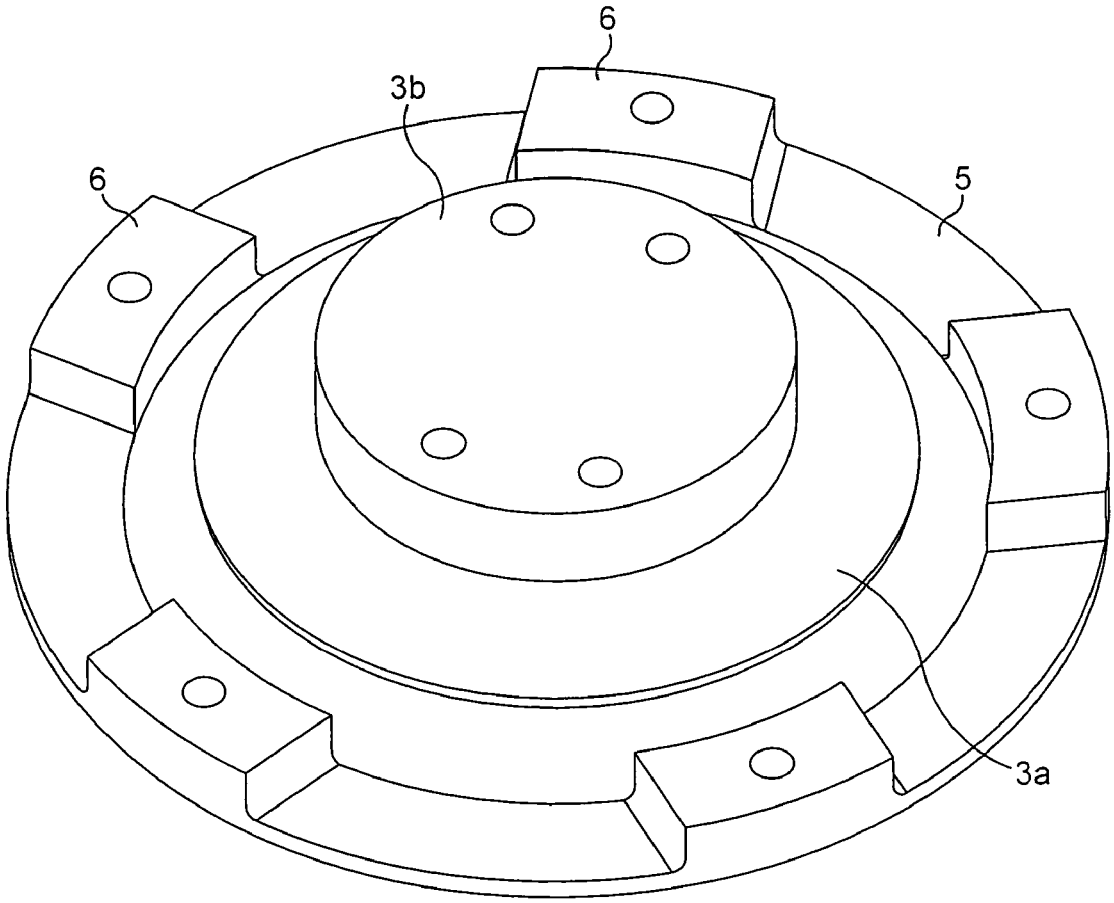
FIG. 5 shows the plate as in FIG. 4, with the button in place as used in the connection system of FIG. 2.
Figure 6:
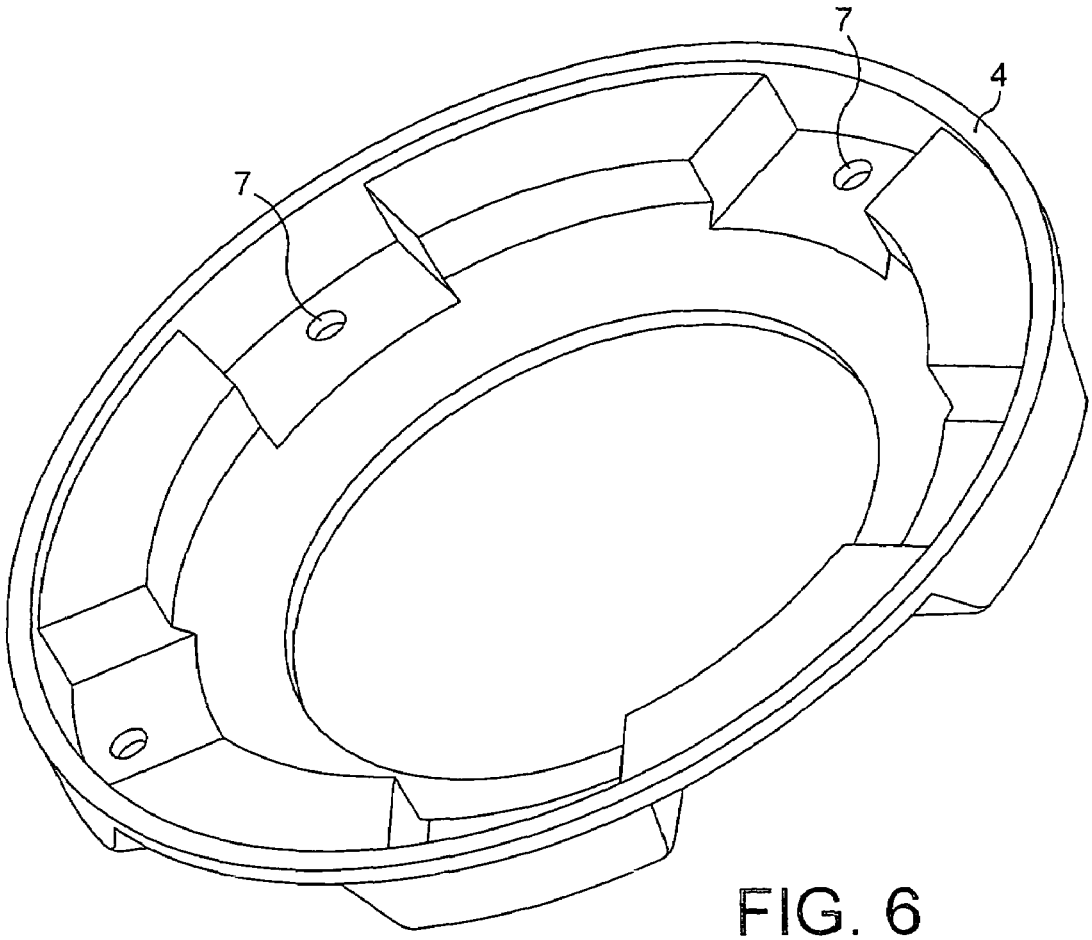
FIG. 6 shows the collar used in the connection system of FIG. 2 viewed from below.
Figure 7:
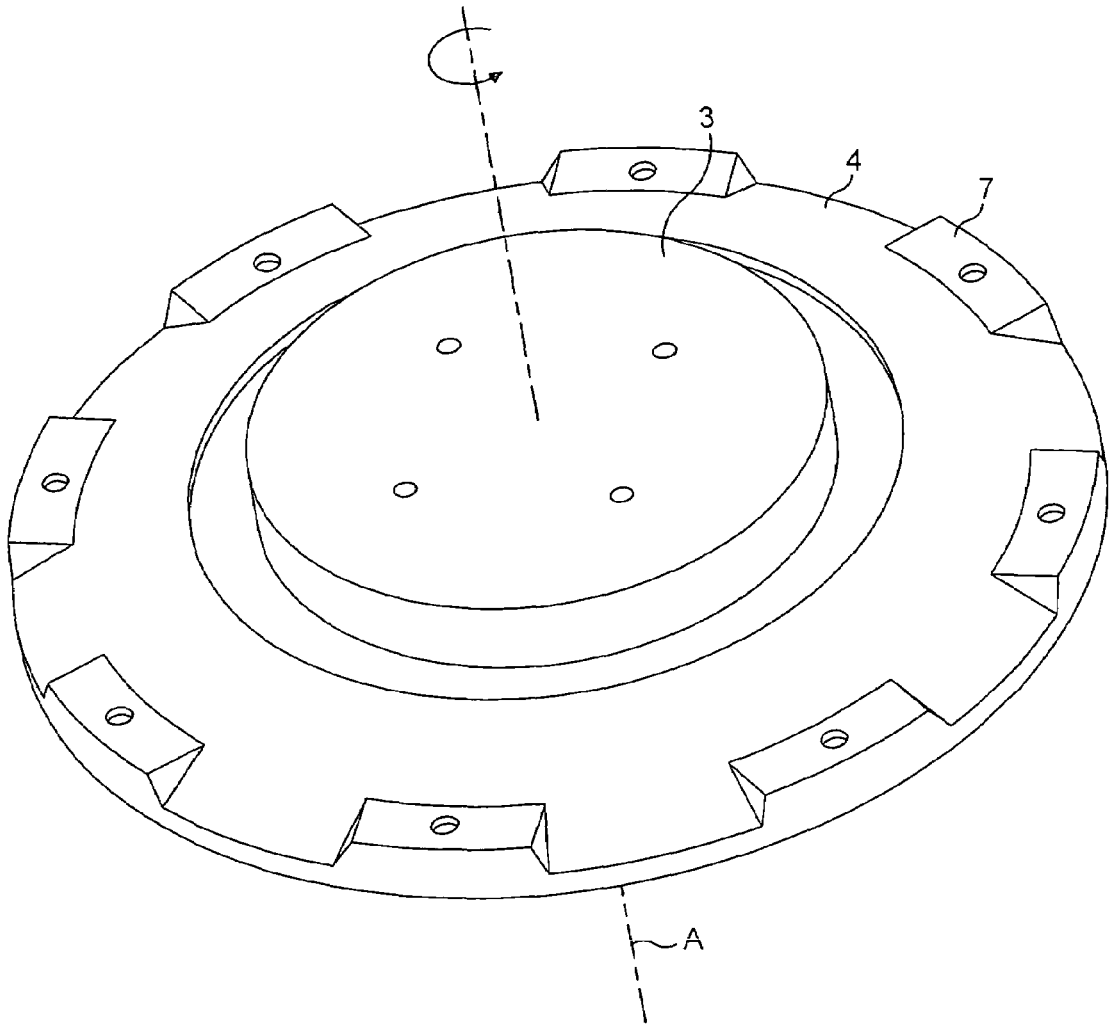
FIG. 7 shows a second embodiment of the connection system.
Figure 8:
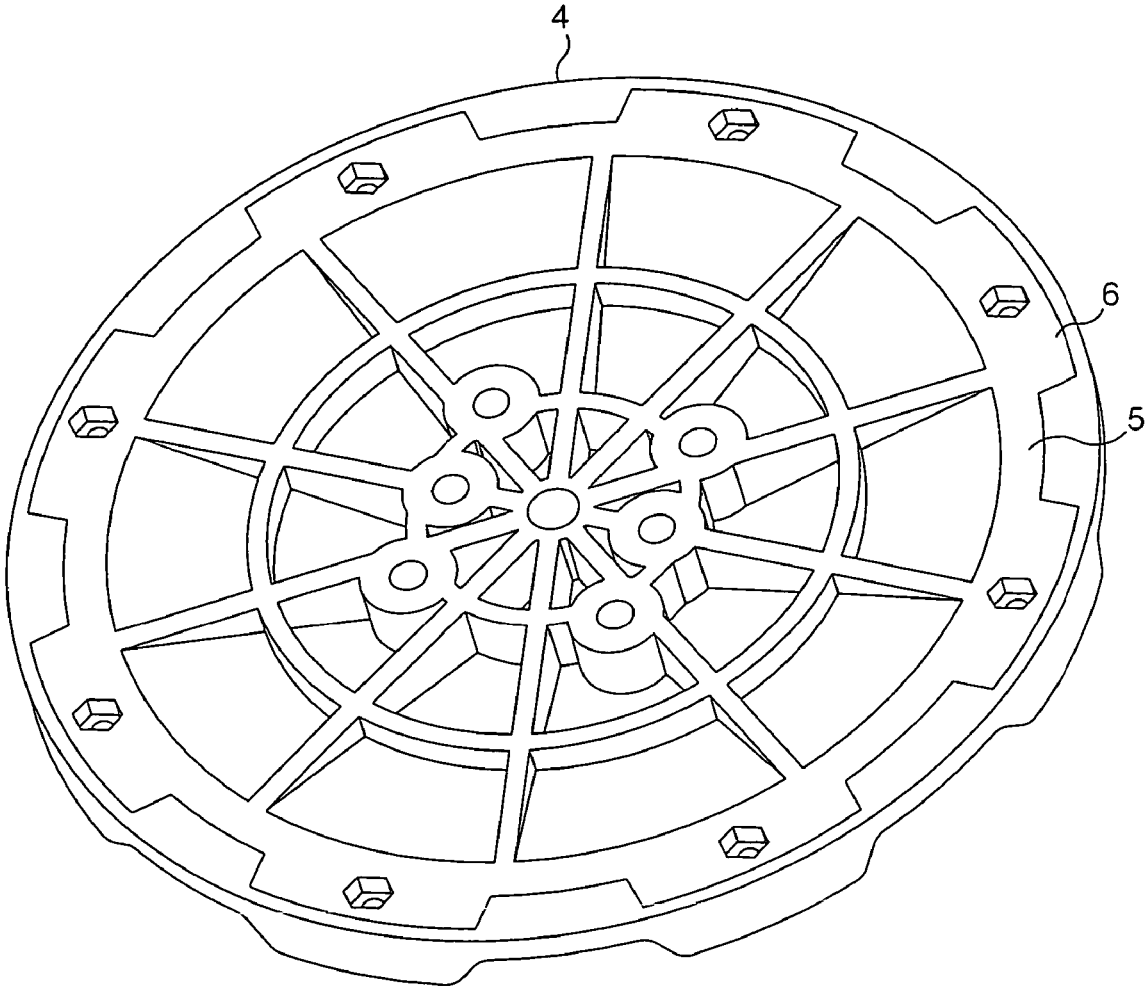
FIG. 8 shows the connection system of FIG. 7 from below.
Figure 9:
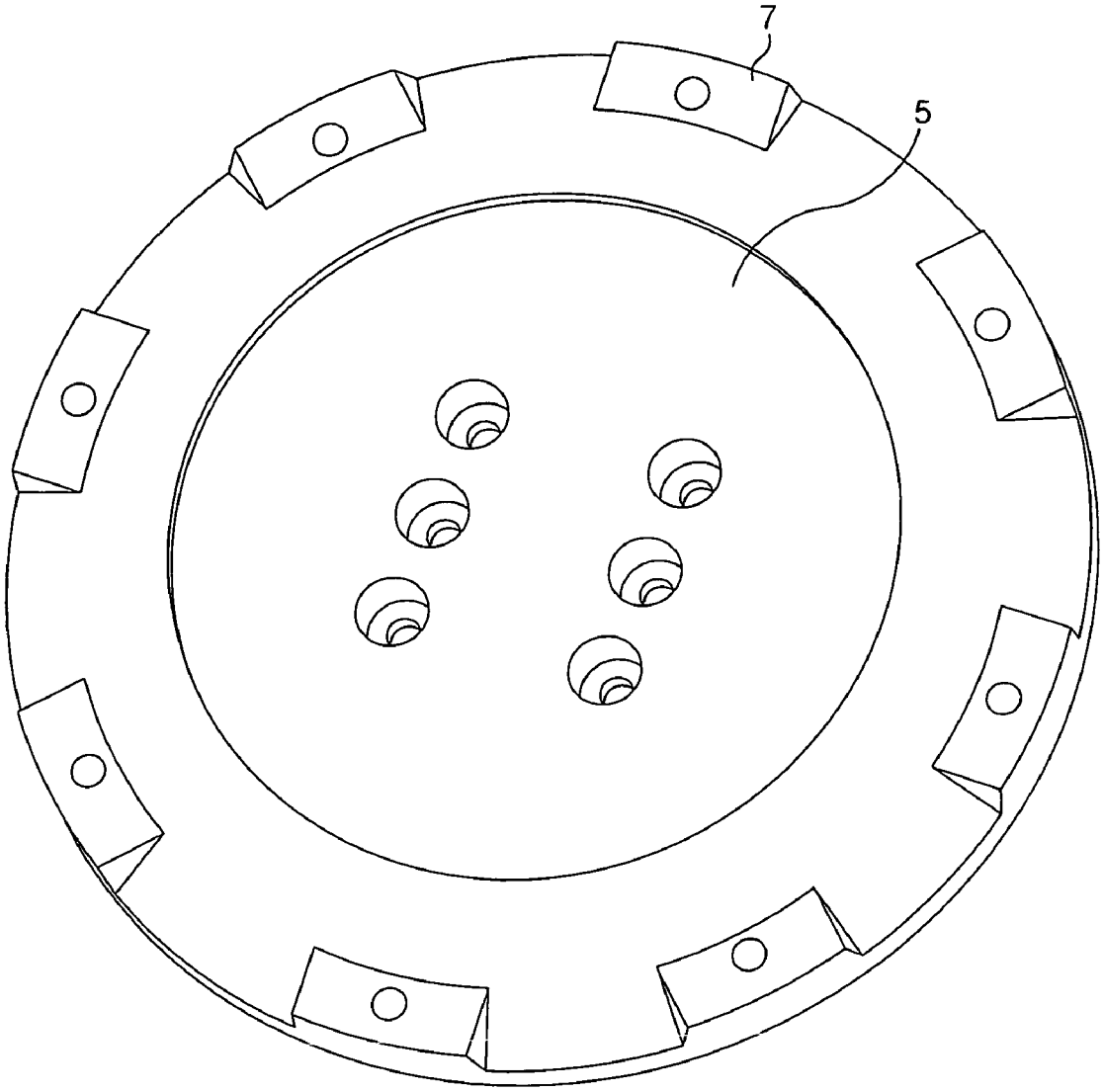
FIG. 9 shows the plate and collar used in the connection system of FIG. 8 with the button omitted.
Figure 10:
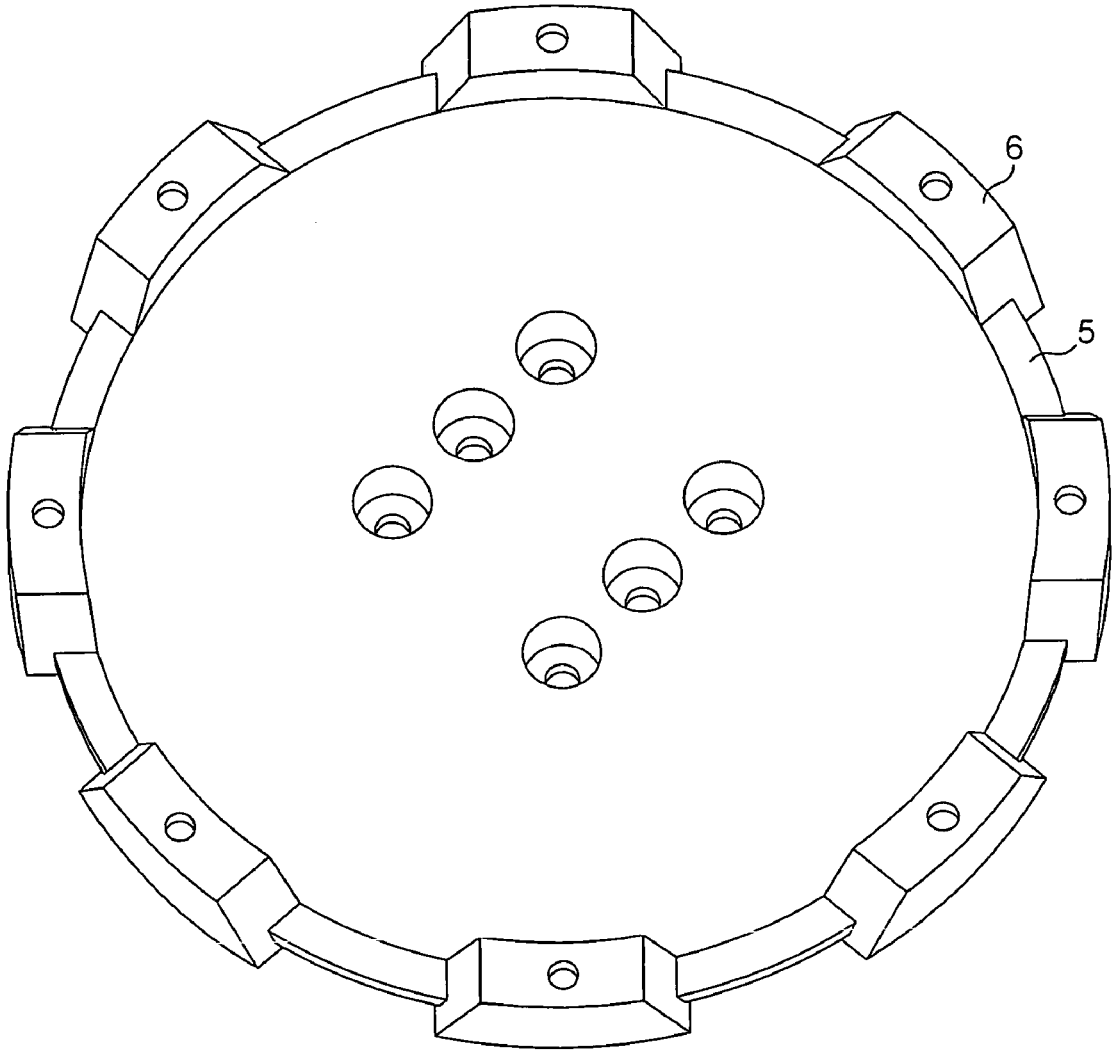
FIG. 10 shows the plate used in the connection system of FIG. 8.

The button 3 has a convex bottom surface, with a domed cavity corresponding in curvature to the plate surface, which adjoins the plate 5 as shown in FIG. 5. The button 3 has a form generally of a hat. It has a flange or rim 3*a* around its lower edge, and a raised portion 3*b* at its centre, with the top face upon the raised portion 3*b*. When assembled, as in FIG. 2, the rim 3*a* is secured under the collar 4, and the raised portion 3*b* is exposed. The binding 2 is secured to the raised portion by means of the holes in the top face, which are arranged to fit with a standard binding arrangement. The raised portion 3*b* ensures that the top face of the button 3 is above the other components, and therefore that the button 3 can rotate without the binding 2 catching against the collar 4. The rim 3*a* is a continuous circular ring shaped portion of the button 3 in order to transfer forces evenly and provide for a smooth sliding operation. However, embodiments are envisaged where the rim 3*a* has other shapes, for example in the form of fingers that engage into the space between the collar 4 and plate 5 to retain the button 3 in place.

The plate 5 has lugs 6 around its outer perimeter, which correspond to recesses 7 in the collar 4. In this embodiment there are five lugs 6 and recesses 7. The lugs 6 can be seen most clearly in FIG. 5 and the recesses can be seen most clearly in FIG. 6, which shows the collar 4 upside down. These lugs 6 and recesses 7 are used to mount the collar 4 onto the plate 5 by means of holes in the lugs 6 and recesses 7. By fitting lugs 6 into recesses 7 the collar 4 cannot rotate relative to the plate 5. As seen in FIG. 3 the base of the plate 5 has hexagonal holes beneath the lugs 6. When the connection system is assembled, hexagonal nuts are placed in the holes before the plate 5 is secured to the board 1. The button 3 is placed on the plate 5 and the collar 4 is then placed over the button 3 and the recesses 7 aligned with and fitted over the lugs 6. The collar 4 is then fixed into place by fitting screws or bolts through the holes in the recesses 7 into the nuts in the base of the plate. The binding 2 is then fitted onto the top face of the button 3.

As can be seen in FIG. 2, the collar 4 does not fit tightly around the raised portion 3*b* of the button 3. As a result the button 3 can slide from side to side and from back to front in a rolling motion relative to the plate 5. With this arrangement, the user can both rotate and roll his boot relative to the board 1. Thus, the boot joined to the button 3 can rotate around the axis A, and the axis A can be angled away from the perpendicular to the board 1 by rolling the button 3 relative to the plate. As discussed above, free movement of the boot relative to the board can reduce strain on the ankles and knees and hence reduce the risk of injury. It also provides more freedom in riding the board and may provide a suspension effect. The rolling movement of the button 3 is limited either by contact between the raised portion 3*b* and the side of the hole in the collar 4, or by contact between the rim 3*a* and an inner edge of the collar 4 or the plate 5. As discussed further below; the rolling movement is can also be restricted by braking means 8. In this way the rolling motion can be limited to acceptable levels. Collars 4 with holes of different diameters, or buttons 3 having raised portions 3*b* of different diameters could be supplied so that the user can adjust how much rolling movement, if any, they can use.

FIGS. 7 to 10 show a second embodiment of the connection system. This embodiment has the same parts as the first embodiment, but the plate 5 has a flatter upper surface, and the button 3 has a corresponding flatter bottom surface, i.e., the radius of curvature of the domed surfaces is slightly greater than in the first embodiment to generated a flatter profile. The plate 5, button 3 and collar 4 are assembled as in the first embodiment. The plate 5 has six holes to fit to an alternative standard arrangement on a board. There are eight lugs 6 and eight recesses 7. As a flatter curved surface is used, the second embodiment has a lower profile than the first embodiment. This is advantageous as the rider is not raised too much above the normal riding position, and therefore the rider's balance is not adversely affected.

Figure 11:
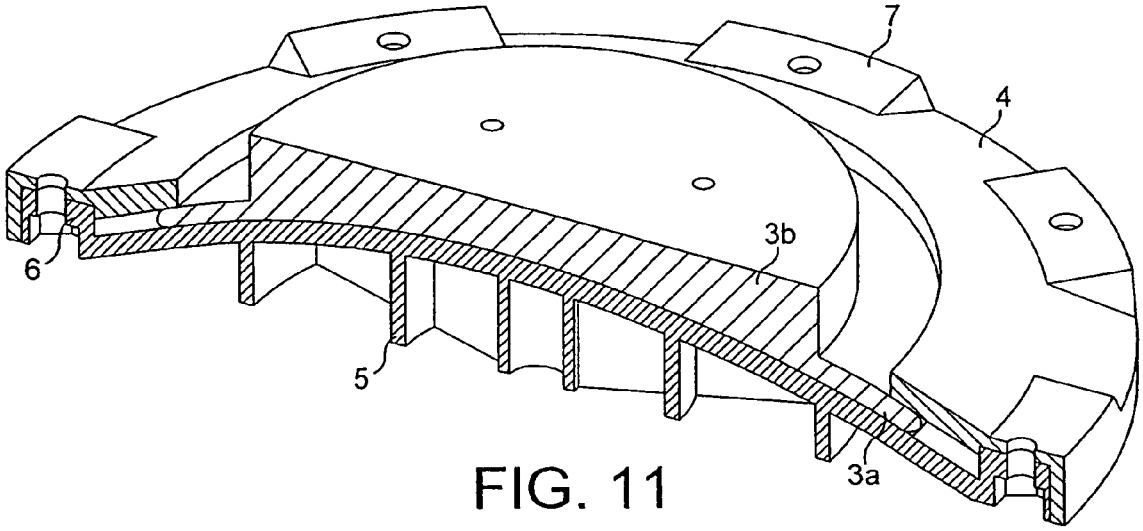
FIG. 11 shows the connection system of FIG. 8 in cross-section.

In FIG. 11 the detail of the connection system can be seen in cross section, including how the lugs 6 fit into the recesses 7, and how the button 3 fits between the collar 4 and the plate 5. The rim 3*a* extends beneath the edge of the collar 4, with a space between the edge of the rim 3*a* and the side of the lugs 6, and a space between the raised portion 3*b* and the edge of the collar 4. These spaces allow the button 3 to slide in a rolling motion beneath the collar 4.

In FIG. 1 the curved surface of the plate 5 is shown in contact with the whole of the bottom surface of the button 3. However, in alternative embodiments, the bottom surface of the button 3 only contacts the plate around its outer perimeter. Thus, in these embodiments, the contact occurs along a circle around the lower edge of the rim 3*a*. Using a small contact surface in this way can avoid the need for highly accurate shaping of the two surfaces, although a large contact surface may be preferable when using some materials to help reduce wear. Other contact surfaces are envisaged where channels or gaps are provided in one or both of the contact surfaces to catch grit or dirt that enters the connection system to prevent the contact surfaces from becoming jammed.

FIGS. 12 to 15 show the connection system of the second embodiment mounted between a board 1 and a binding 2. The system is shown in a central position in FIG. 12, and performing a rolling motion to the side, back and front in FIGS. 13 to 15 respectively. As will be appreciated, the motion shown in these figures would occur similarly in the first embodiment of the invention described above.

Figure 12:
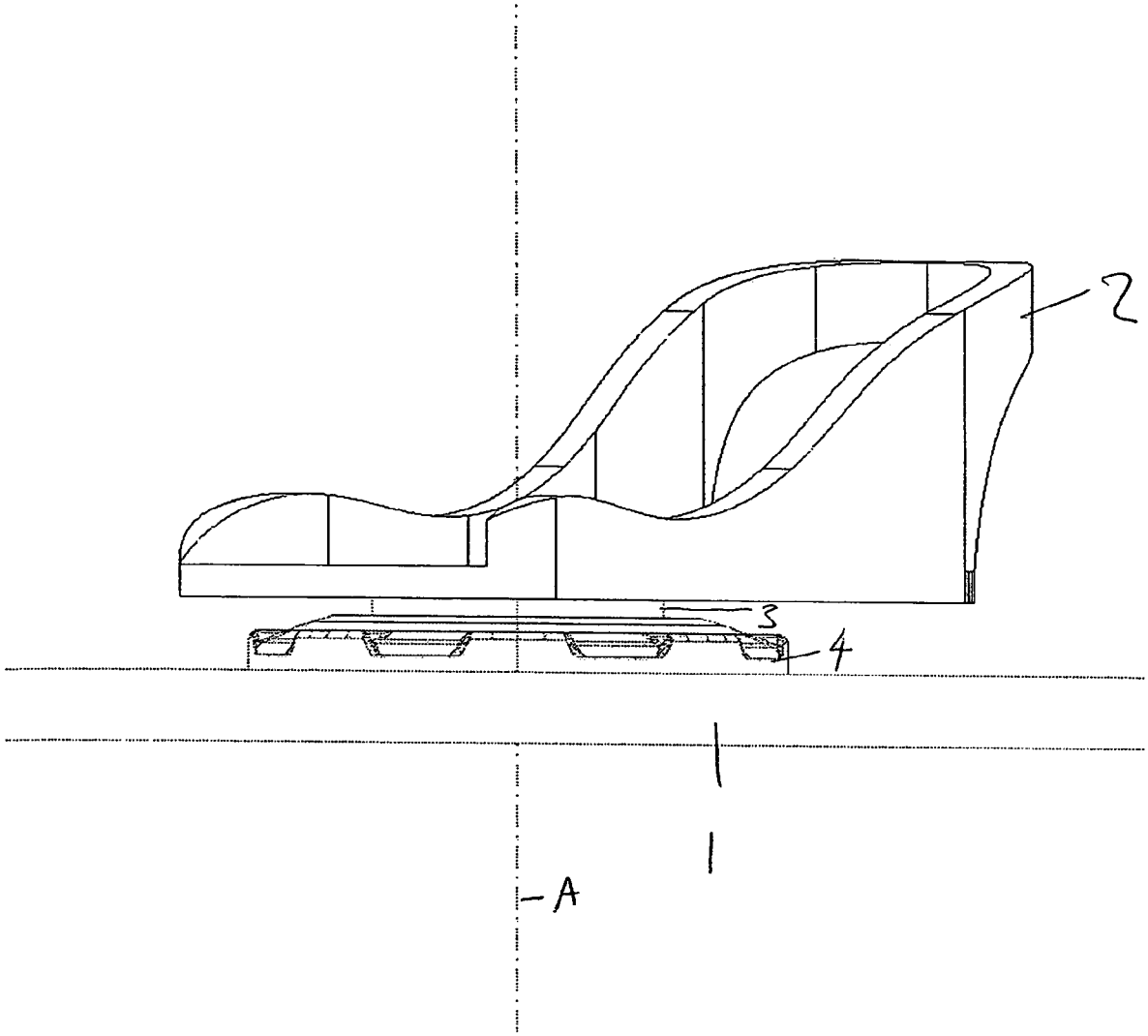
FIG. 12 shows a close up of the connection system mounted between a board and a binding.
Figure 13:
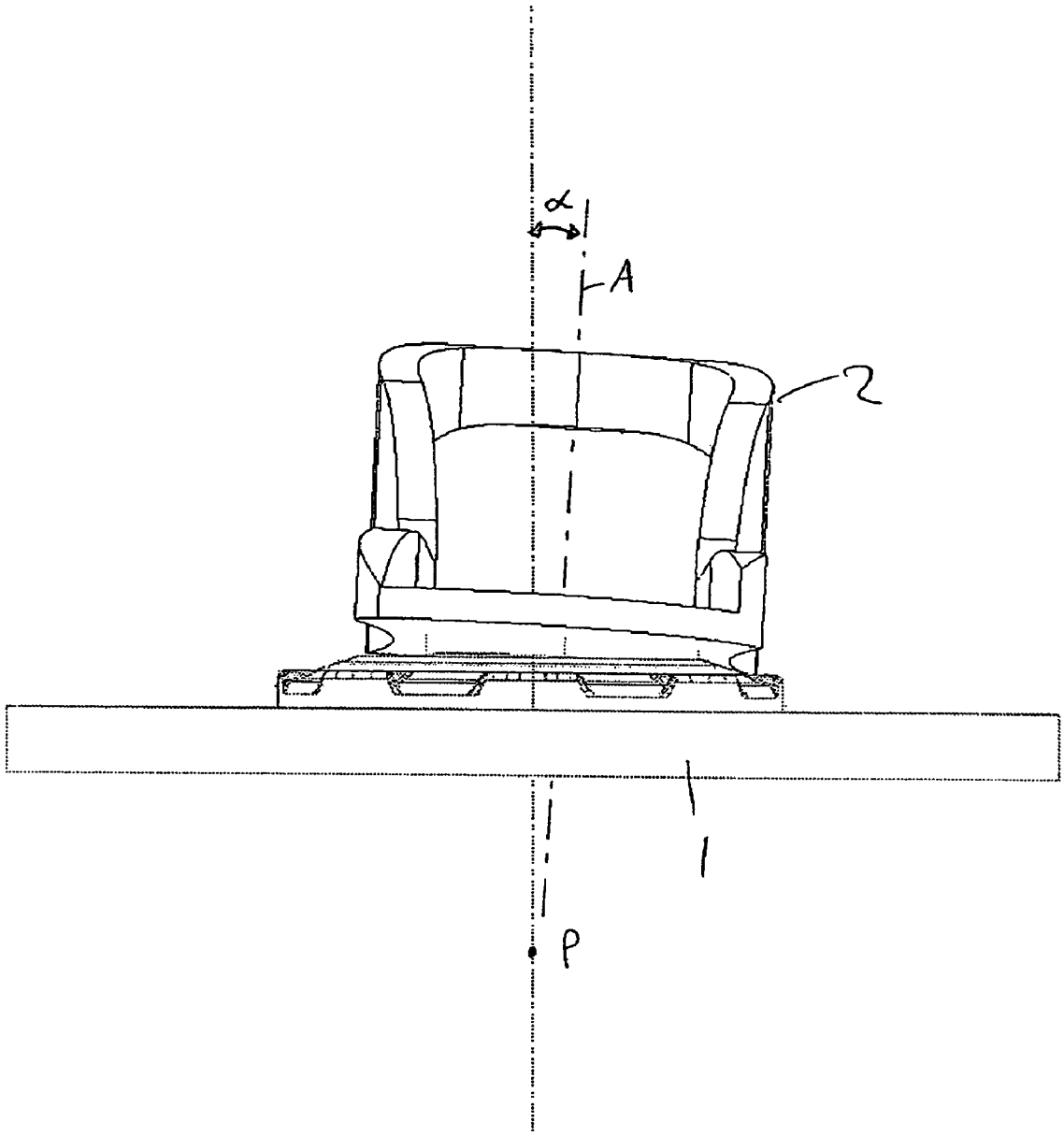
FIG. 13 shows the connection system of FIG. 12 performing a rolling motion to one side.
Figure 14:
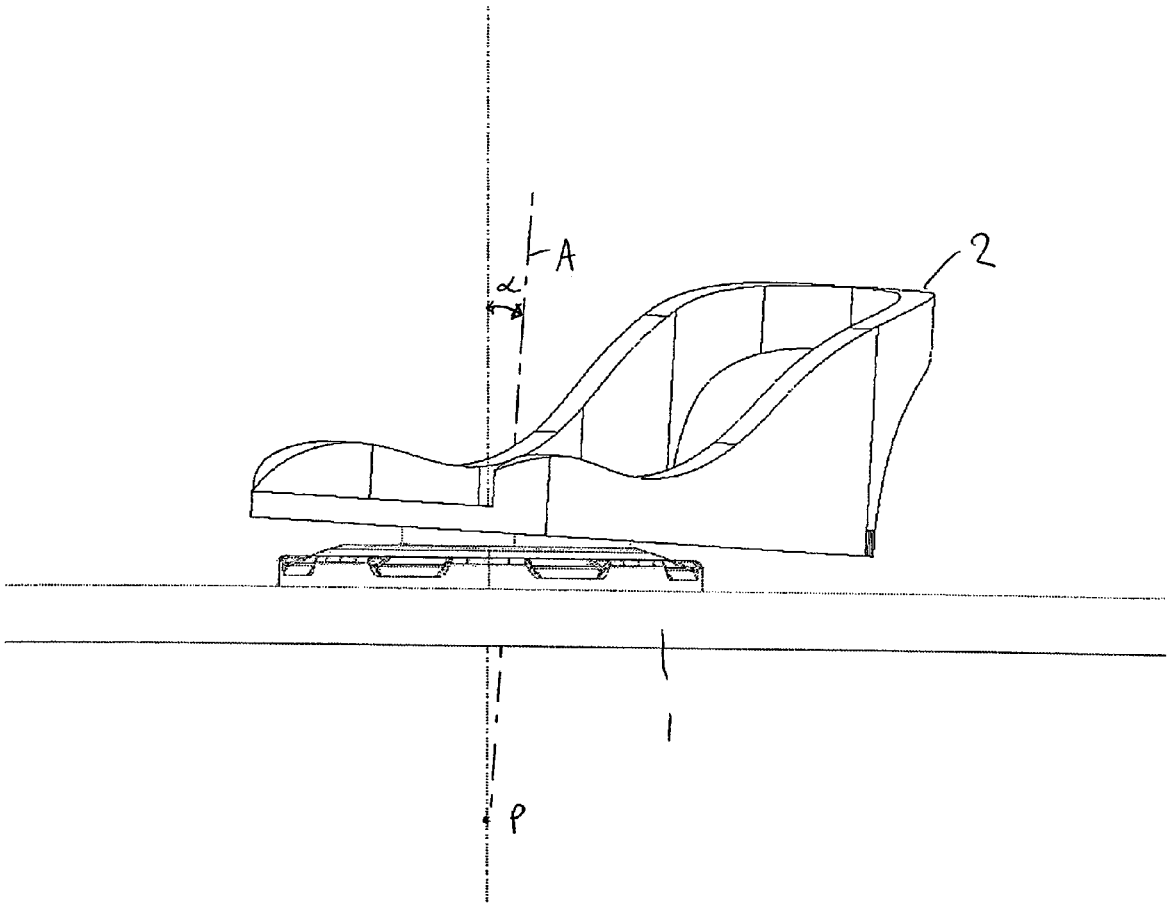
FIG. 14 shows the connection system of FIG. 12 performing a rolling motion to the back of the binding.
Figure 15:
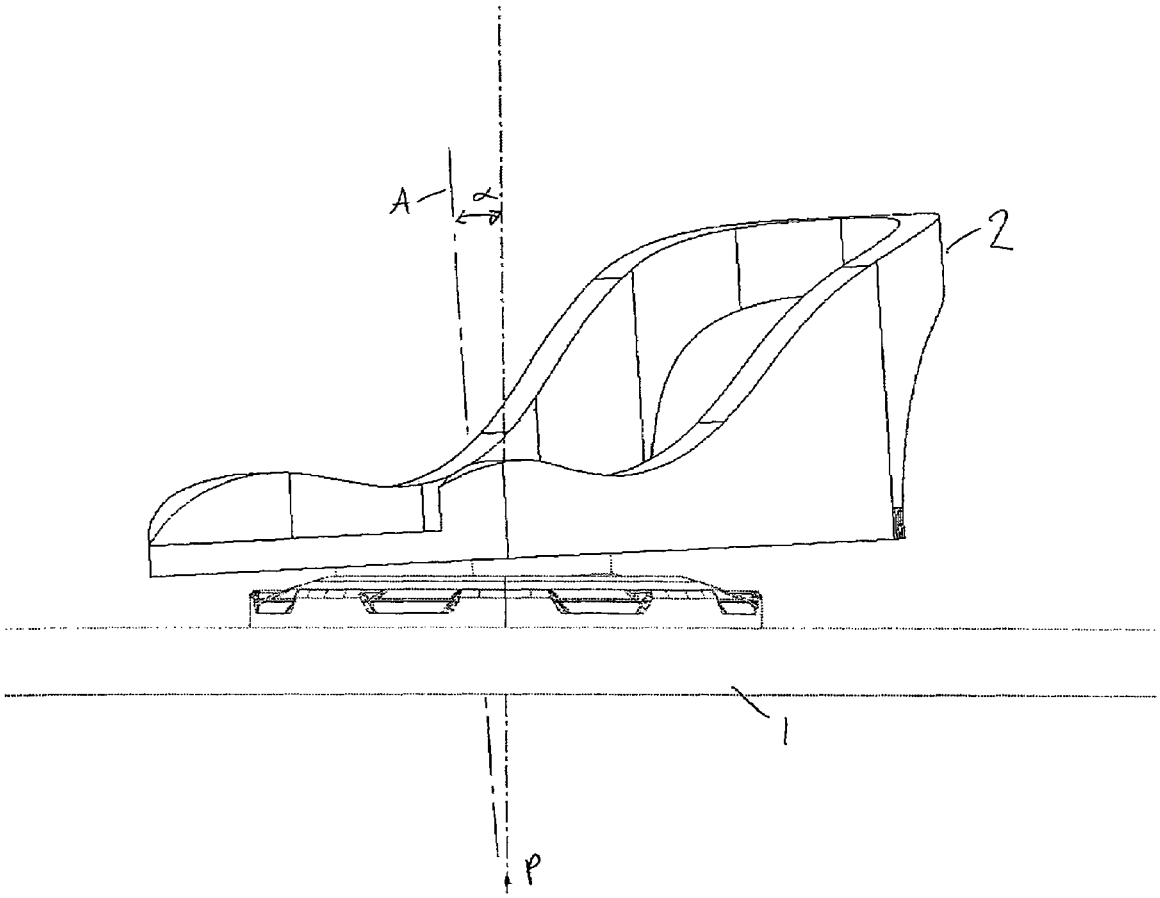
FIG. 15 shows the connection system of FIG. 12 performing a rolling motion to the front of the binding.

In FIG. 12 the axis A is perpendicular to the board 1. In FIGS. 13 to 15 the axis A is at an angle a to the perpendicular to the board 1. As the centre of rotation of the button 3 is the centre of the curve of the upper surface of the plate, the angle $\alpha$ is an angle created by the intersection of the axis A, which is normal to the top surface of the button 3 and the perpendicular to the board 1 at a point P, which is shown approximately on the figures.

In the embodiment shown, the angle $\alpha$ has a maximum of between approximately 3° and 5°. This allows the axis A to move within a region corresponding to an inverted cone having a cone angle of $2\alpha$. By varying the relative size of the collar 4, button 3 and plate 5, the maximum value of $\alpha$ can be adjusted to suit the preference of a rider. For example, if the size of the hole in the collar 4 was made smaller, then the edge of the raised portion 3*b* of the button 3 would limit the movement of the button 3 to a smaller angle.

Figure 16:
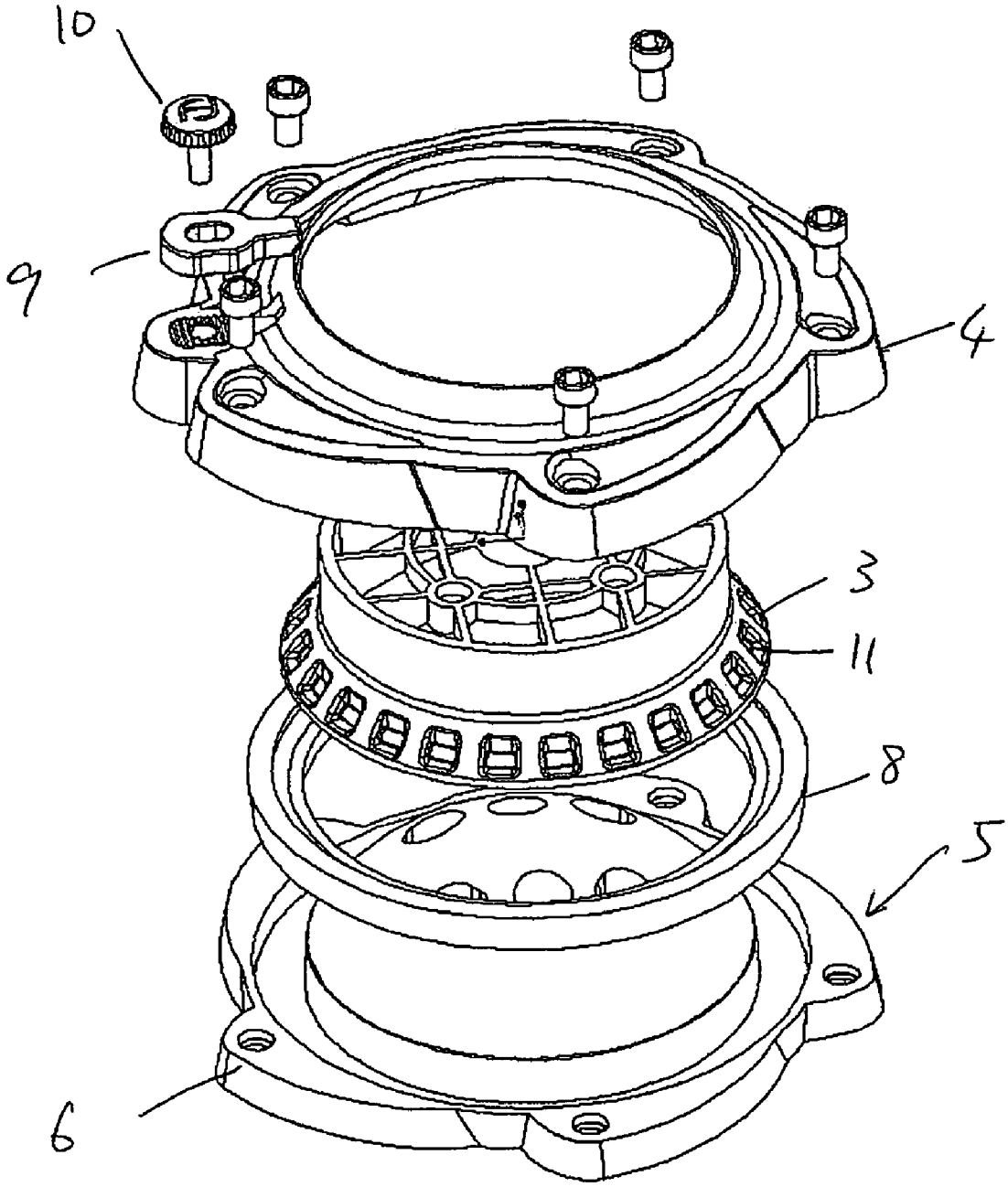
FIG. 16 is an exploded view of the connection system showing the braking means.

FIG. 16 shows an exploded view of a plate 5, braking means 8, button 3 and collar 4. In this embodiment the braking means 8 is a ring of resilient material positioned around the outer rim of the button 3 so that the rim of the button 3 engages with the braking means when the button moves by a certain angle. This is explained in more detail below.

FIG. 16 also shows a locking means comprising a latch 9 and a bolt or screw 10. The latch 9 can be secured to the collar 4 by the bolt or screw 10, and when secured it engages with a recess 11 in the button 3, thereby fixing the button 3 in place and preventing rotation. Rolling motion of the button 3 can still occur if desired. The degree of rolling motion can be adjusted by adjusting the distance that the latch 9 protrudes into the recess 11. Recesses are provided all around the button 3 so that any desired position can be used.

Figure 17:
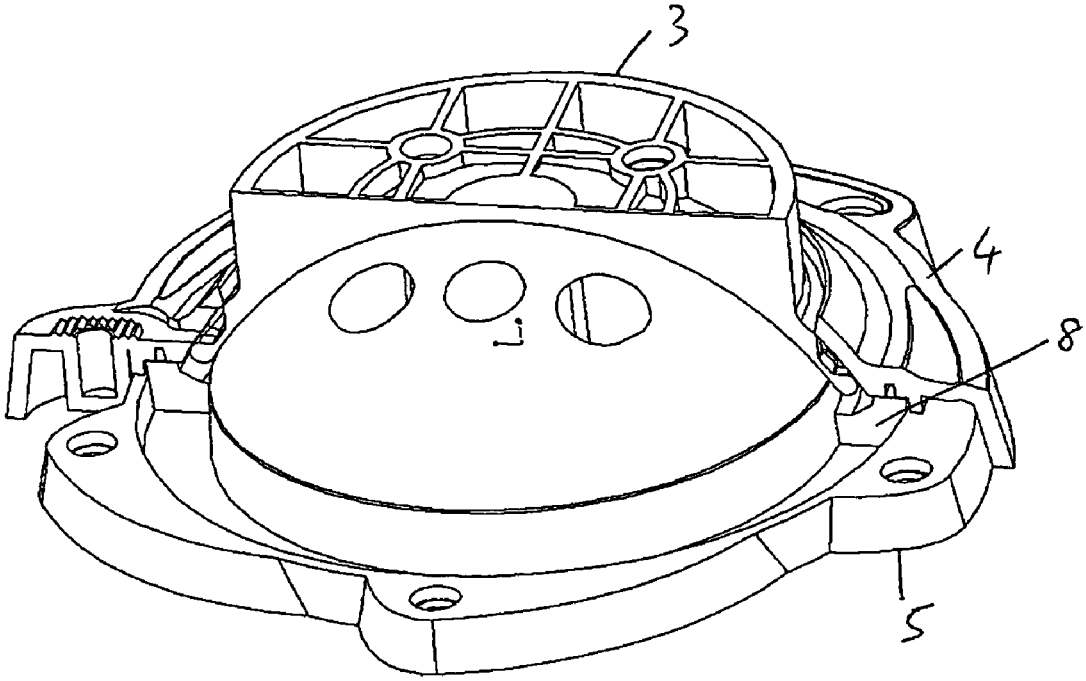
FIG. 17 shows a partial section view of the connection system of FIG. 16.
Figure 18:
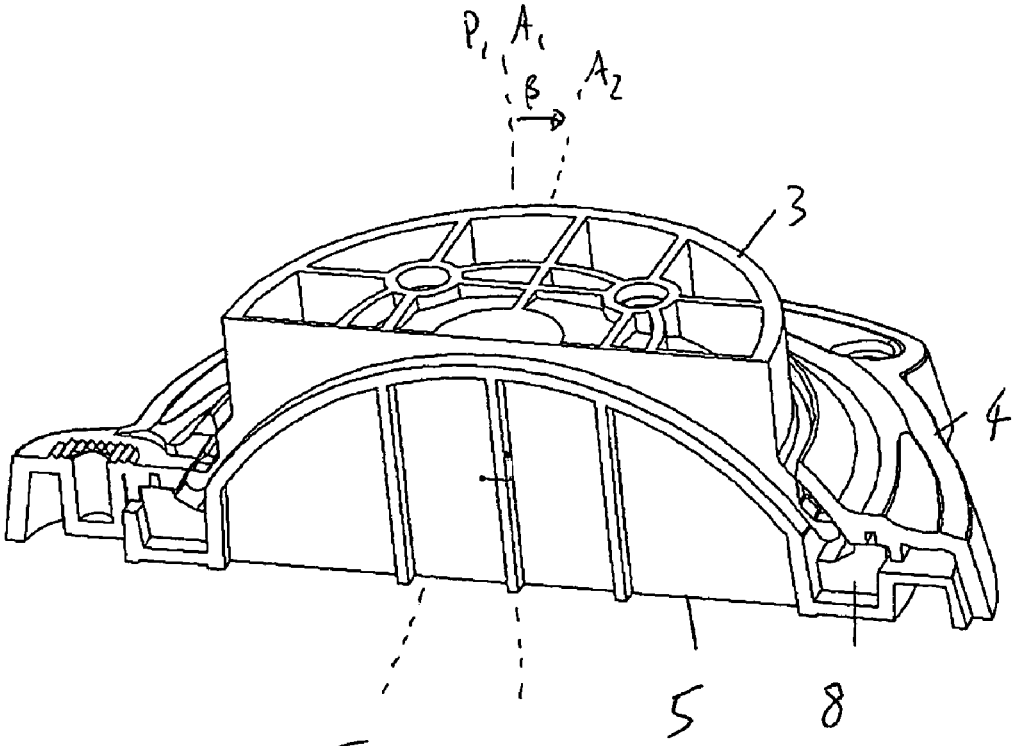
FIG. 18 is a cross-section of the connection system of FIG. 16.

FIGS. 17 and 18 show in partial section and cross-section a perspective view of the connection system of FIG. 16 when assembled. The braking ring 8 and the button 3 are secured in place by the collar 4. The button 3 is shown in the central position, where the axis of rotation A is the same as the perpendicular to the button P. This axis is labelled $A_1$. When the button 3 rolls to a certain point, such that the angle between the perpendicular P and the new position of the axis of rotation, denoted $A_2$ is $\beta$, then the rim of the button 3 will engage with the braking ring 8. To move the button 3 further in a rolling motion then force will need to be applied to deform the resilient material of the braking ring 8. This mechanism provides better control of the board 1 for the rider, as the rolling and/or the rotational movement of the button 3 can be restricted by the braking means. For example, friction between the rim of the button 3 and the braking means 8 can prevent rotational movement. By selecting an appropriate size and material the braking effect can occur at a larger or smaller value of the angle $\beta$, and the force required to move the button 3 against the braking means 8 can be varied, both in terms of force to deform the braking means 8 and roll the button 3, and force to overcome frictional resistance to rotational movement when the button 3 is in contact with the braking means.

Figure 19:
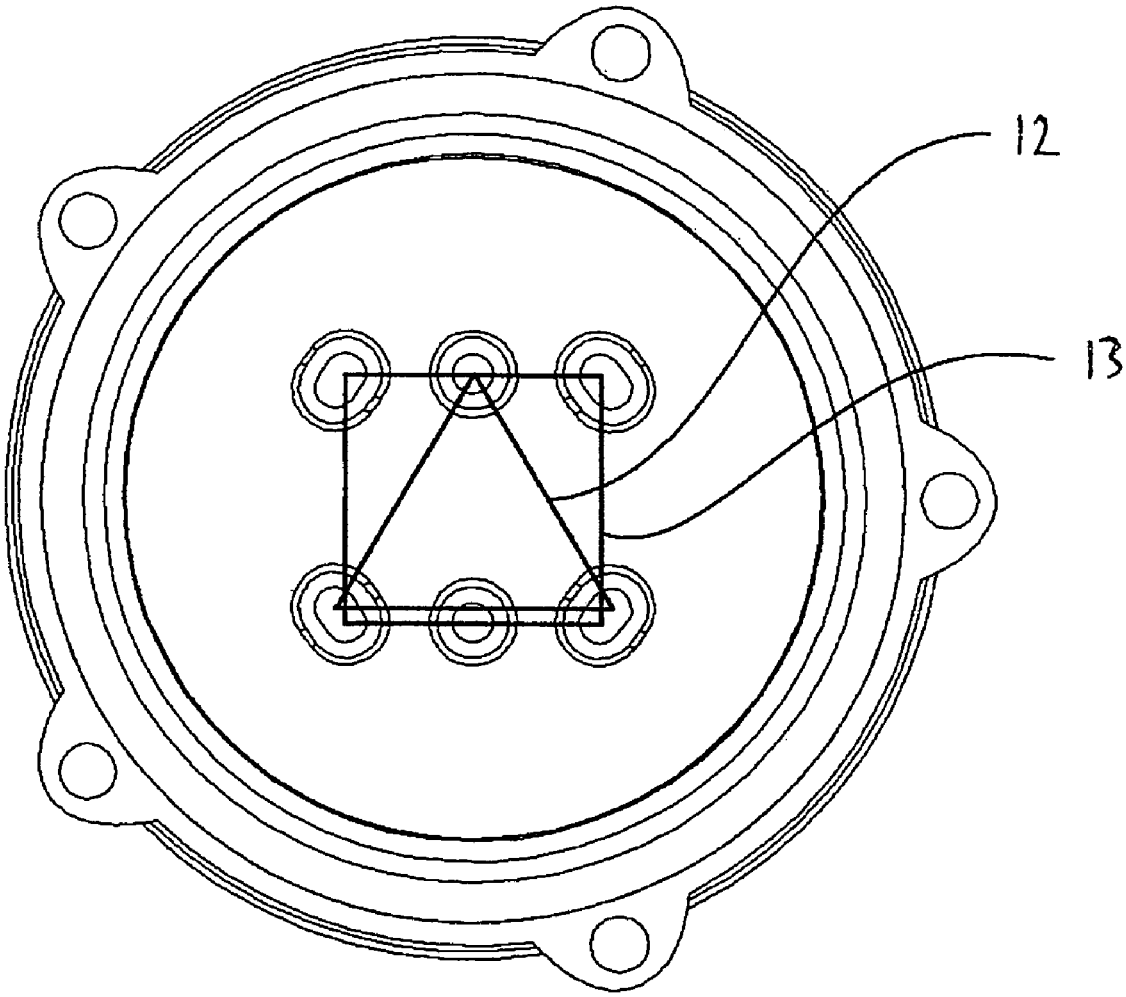
FIG. 19 shows different standard mounting arrangements.

FIG. 19 shows different standard arrangements of mounting holes which can be used. A standard 6 hole arrangement can be adapted to also fit with a 3 hole Burton arrangement. As will be appreciated, the connection system can have any desired arrangement of mounting holes on the plate and the button to connect to standard arrangements of holes provided on conventional boards and bindings.

Figure 20:
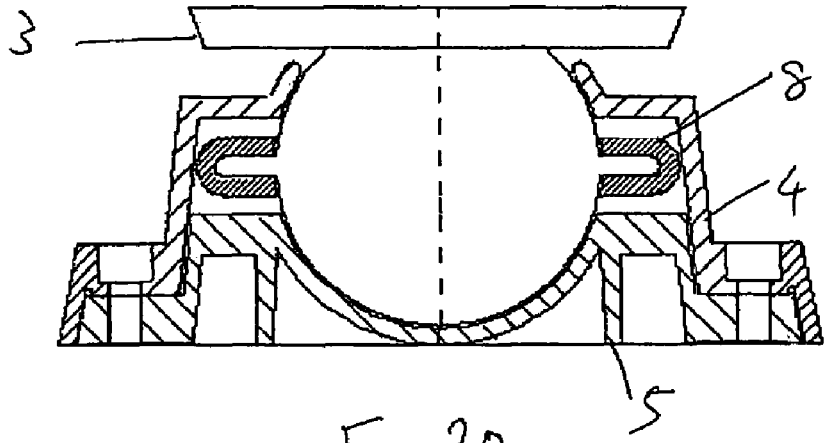
FIGS. 20, 21 and 22 show various alternative embodiments of the connection system.
Figure 21:
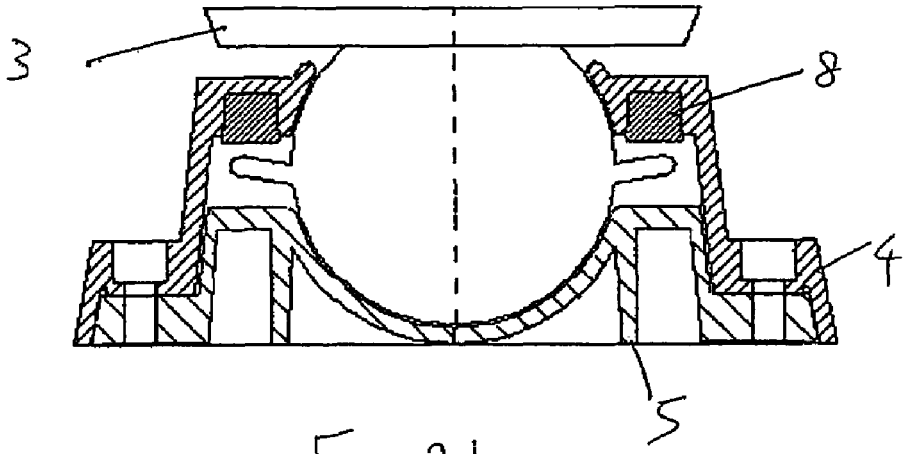
Figure 22:
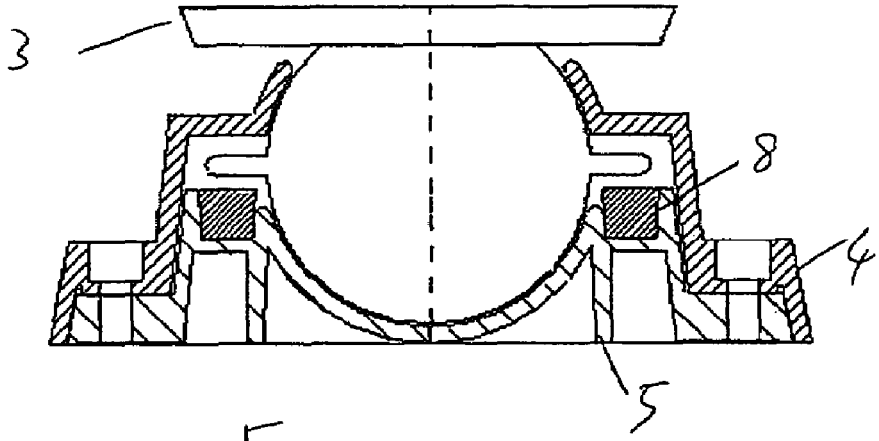

It will be appreciated that a similar range of movement of the foot could be achieved using a cavity in the plate 5, into which fits a convex surface on the button 3. FIGS. 20, 21 and 22 show various embodiments of this sort, with a spherical surface on the button 3, and a corresponding recess in the plate 5. The rim of the button 3 can protrude from the side of the spherical surface. These figures also show various different alternative positions for the braking means. In FIG. 19 the braking means is around the rim of the button, and thus will engage with the collar 4 and/or the plate 5 when the button rolls past a certain angle. In FIGS. 20 and 21 the braking means is a ring placed above the rim on the collar and below the rim on the plate respectively. Similar variations in the location of the braking means can be implemented with the connections systems described above where the plate 5 has the convex surface.

The plate 5, button 3 and collar 4 can be made by injection moulding, and conventional polymers can be used such as nylon, PTFE (Teflon), polyethylene, polyacrylates, polyurethanes and compositions including these materials and other polymer materials and additives. Conventional injection moulding apparatuses and methods can be used. As a result, the connection system can be easily and cheaply manufactured. By careful selection of a suitable plastic, a low coefficient of friction can be combined with low wear between the moving parts. Additionally, the plastic can be selected to be tough and resistant to corrosion and environmental effects. As a snowboard would be moved between hot and extremely cold environments, it is also useful that plastics do not have high thermal expansion coefficients, particularly when compared to metals.

The invention claimed is:

1. A connection system for connecting a board (1) to a boot, the connection system comprising:

a plate (5) which is connectable to a board, a button (3) having a bottom face and a top face, the top face being connectable to a boot or binding (2), and a collar (4), wherein a portion of the button (3) is sandwiched between the collar (4) and the plate (5) with the bottom face of the button (3) adjoining the plate (5), and the top face of the button (3) exposed through the collar (4), such that the button (3) can rotate about an axis (A) passing through the connection system, wherein the bottom face of the button (3) has a curved surface, which has rotational symmetry with and which adjoins a complimentary curved surface on the plate (5), such that button (3) can roll to move its axis of rotation (A) away from an axis (P) perpendicular to the plate (5), and the connection system comprises braking means (8) for restricting rolling and/or rotational movement of the button (3) when the button is moved away from a neutral position.

2. A connection system as claimed in claim 1, wherein the braking means (8) resiliently restricts rolling and/or rotational movement of the button (3) when the axis (A) reaches a predetermined angle (β) from the perpendicular (P).

3. A connection system as claimed in claim 2, wherein the braking means (8) is located about the button (3), so that when the axis (A) reaches the predetermined angle (β) the braking means (8) is compressed between the button (3) and another part of the connection system.

4. A connection system as claimed in claim 1, wherein the braking means (8) comprises a ring of resilient material.

5. A connection system as claimed in claim 1, wherein the braking means (8) is arranged to provide an urging force to return the button (3) to a neutral position when the button (3) is engaged with the braking means (8).

6. A connection system as claimed in claim 1, wherein the braking means (8) engages frictionally with the button (3) under force applied by a rider in use to thereby prevent rotation of the button (3).

7. A connection system as claimed in claim 1, comprising a locking means having a latch (9), the latch (9) being connected to the collar (4) or plate (5) and being engageable with the button (3) to thereby prevent rotation of the button.

8. A connection system as claimed in claim 1, wherein the button comprises:

a rim (3*a*) around its lower edge, part of which is sandwiched between the collar (4) and the plate (5), and a raised portion (3*b*) at its centre, which protrudes through the collar, and wherein the top face is upon the raised portion.

9. A connection system as claimed in claim 1, wherein the curved surface of the plate (5) includes a section of a sphere, and the bottom surface of the button (3) is a cavity of corresponding shape.

10. A connection system as claimed in claim 1, wherein the plate (5) has mounting holes arranged to allow connection to one or more of standard 4 hole, 6 hole or 3 hole arrangements provided in a board (1) for a binding.

11. A connection system as claimed in claim 1, wherein the button (3) comprises mounting holes arranged to allow connection to one or more of standard 4 hole, 6 hole or 3 hole arrangements in a binding (2).

12. A connection system as claimed in claim 1, wherein the plate (5) has a plurality of lugs (6) on its upper surface arranged around its outer edge and the collar (4) has a corresponding plurality of recesses (7) on its under surface arranged around its outer edge for engagement with the lugs.

13. A connection system as claimed in claim 1, wherein one or more f the plate (5), button (3) and collar (4) are manufactured using injection moulding.

14. A connection system as claimed in claim 1 for use with a conventional snowboard, wakeboard, skateboard, mountain board, windsurf, kite board, power board, or any kind of sports board and the corresponding binding.

15. A snowboard having a connection system as claimed in claim 1 fitted to a first foot position of the board.

16. A snowboard as claimed in claim 15 having a second connection system as claimed in claim 1 fitted to a second foot position of the board.

17. A kit for a board, the kit comprising a connection system as claimed in claim 1, wherein more than one button (3) and/or more than one braking means (8) is provided in the kit, the plurality of buttons (3) and/or braking means being of different sizes, shapes or hardness to allow different ranges of movement.

* * * * *

UNITED STATES PATENT AND TRADEMARK OFFICE

CERTIFICATE OF CORRECTION

PATENT NO. : 7,658,398 B2
APPLICATION NO. : 11/481920
DATED : February 9, 2010
INVENTOR(S) : Ezio Panzeri It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 776 days.

Signed and Sealed this

Twenty-eighth Day of December, 2010

David J. Kappos

David J. Kappos
*Director of the United States Patent and Trademark Office*